United States Patent [19]

Damiano

[11] Patent Number: 4,646,804

[45] Date of Patent: Mar. 3, 1987

[54] HANDBAG FOR PLAYING BINGO

[76] Inventor: Mary Damiano, 150 Whitehall Rd., Albany, N.Y. 12209

[21] Appl. No.: 783,367

[22] Filed: Oct. 3, 1985

[51] Int. Cl.[4] ..... A45C 3/06; A45C 13/10; A45C 13/36; B65D 33/02

[52] U.S. Cl. ..... 150/112; 150/118; 150/130; 206/315.1; 273/148 R; 383/2; 383/38; 383/72; 383/119

[58] Field of Search ..... 206/315.1; 383/72, 2, 383/4, 3, 38, 119; 273/269, 148 R; 150/112, 118, 130

[56] References Cited

U.S. PATENT DOCUMENTS

| | | | |
|---|---|---|---|
| 875,398 | 12/1907 | Willis | 383/22 |
| 1,207,533 | 12/1916 | Gamble | 383/38 X |
| 1,681,922 | 8/1928 | Boch | 383/39 |
| 1,683,678 | 9/1928 | Kitterman et al. | 383/4 X |
| 1,810,347 | 6/1931 | Daitch | 383/2 |
| 2,425,683 | 8/1947 | Martin | 383/6 |
| 2,466,208 | 4/1949 | Chanslor et al. | 150/112 X |
| 2,522,604 | 9/1950 | Courter | 383/72 X |
| 2,729,257 | 1/1956 | Kepper | 383/2 |
| 3,285,307 | 11/1966 | Dormaier | 383/4 |
| 3,746,066 | 7/1973 | McIntyre | 383/2 X |
| 3,871,519 | 3/1975 | Groomes | 206/315.1 X |

*Primary Examiner*—William Price
*Assistant Examiner*—Sue A. Weaver
*Attorney, Agent, or Firm*—Schmeiser, Morelle & Watts

[57] ABSTRACT

In a drawstring handbag, a series of pockets having top openings which are less than or equal to 3/5 of the distance from the bottom to the top of the bag. The walls of the handbag are flexible and a strip, less flexible than the walls, is secured about the bag so as to facilitate the folding of the top portion of the bag downward over the exterior of the bottom portion of the bag. A cup is secured to the base of the bag for the holding of Bingo chips and the like.

3 Claims, 2 Drawing Figures

HANDBAG FOR PLAYING BINGO

FIELD OF THE INVENTION

Generally, this invention relates to handbags. More specifically, this invention relates to that type of handbag generally referred to as "drawstring" handbags and is particularly adapted for playing the game of Bingo.

BACKGROUND AND OBJECTS OF THE INVENTION

The game of Bingo is widely played by individuals of all ages. Playing Bingo requires a variety of paraphenalia including chips, ink markers, pens, pencils, tape, and in some cases other devices such as magnetic wands for picking up chips. Players carry this paraphenalia in everything from paper bags to beach bags and array the items on their table in preparation of playing. To date, no product has been invented for holding and arranging these items for easy transportation and access while playing Bingo.

Handbags, as known today, come in a wide variety of sizes and shapes. In addition, they often incorporate special features such as zipper pockets for change, snap on key rings, tethered flashlights, as well as a variety of other accessories.

One type of handbag which has had varying degrees of acceptance is commonly referred to as a "drawstring" handbag. This handbag is generally tubular in configuration, having drawstrings about its uppermost circumference. These drawstrings are mainly enclosed within the interior portions of the handbag, however, drawstring loops on opposed sides of the handbag are exposed. Pulling upon these drawstring loops gathers the material about the top of the handbag, thereby closing the top opening.

A more detailed description of these types of handbags appears in U.S. Pat. No. 875,398, U.S. Pat. No. 1,681,922, and U.S. Pat. No. 2,425,683.

The drawstring handbags described above as well as most other handbags are adapted to be most convenient for a specific type of use. Namely, these handbags serve to hold a significant number of items and allow access to these items, usually one item at a time, from the top opening of the bag. This has led away from handbags such as the original drawstring handbags which simply collected all items mixed together within the handbag and has led to the development of pockets within the handbags. For convenience and ease of access, the openings for these pockets are placed near to the top of the handbag so that other items within the handbag neither block nor interfere with access to the pockets.

While these handbags have met the need for which they were intended, they are not suitable for holding Bingo items and arranging them during play. Thus, the Bingo player must unpack and pack his or her Bingo playing items each time they go to play the game. In addition, since these Bingo items are generally spread out during play, one must also cope with the difficulties encountered due to a lack of room, a problem which is common in most halls, and the concomitant overlapping of the player's items. This is especially compounded when one considers the fact that most markers and the like are virtually indistinguishable one from another.

With these ideas in mind, I began to develop a handbag specifically for the Bingo player.

It is therefore an object of this invention to provide a new and improved handbag which is capable of holding the various items needed to play Bingo in an organized manner.

It is another object of this invention to provide new and useful handbag for Bingo items which can be converted to a holder for displaying the items in an accessible array for use while playing the game.

Another object of this invention is to provide a handbag for carrying Bingo items which is inexpensive to manufacture and easy to use.

Other objects and advantages of the invention are set forth in part herein and in part will be obvious herefrom, or may be learned by using the invention, the same being realized and attained by means of the instrumentalities and combinations pointed out in the appended claims.

This invention consists in the novel parts, constructions, arrangements, combinations and improvements herein shown and described.

SUMMARY OF THE INVENTION

It has been found that the objects of this invention may be realized by forming a drawstring handbag within interior pockets wherein the top openings of the pockets are significantly below the top of the handbag. A relative non-flexible strip about the circumference of the handbag allows the top portion of the bag to be quickly and easily folded downward to a specific point wherein the itmes within the pockets extend above the new formed top of the bag. Advantageously, a cup secured to the base of the bag and having a removable cover may be used for holding playing chips.

The handbag of this invention provides a remarkably versatile holder for Binger items. The pens, markers, and wands are easily placed within the pockets formed in the bag and since the pockets extend no more than 3/5 the distance up along the sides of the bag, the items do not extend out of the top of the bag when the handbag is in its fully extended position. When the top portion of the handbag is folded downwardly about the exterior of the rear portion, the marking instruments are clearly displayed. Similarly, the cup secured to the base of the bag is easily accessible when the bag is in this partially inverted position, thereby facilitating easy access. The accompanying drawings referred to herein and constituting a part hereof, illustrate the preferred embodiment of the invention, and together with the description, serve to explain the principles of the invention.

DESCRIPTION OF THE PREFERRED EMBODIMENT

Figure 1:
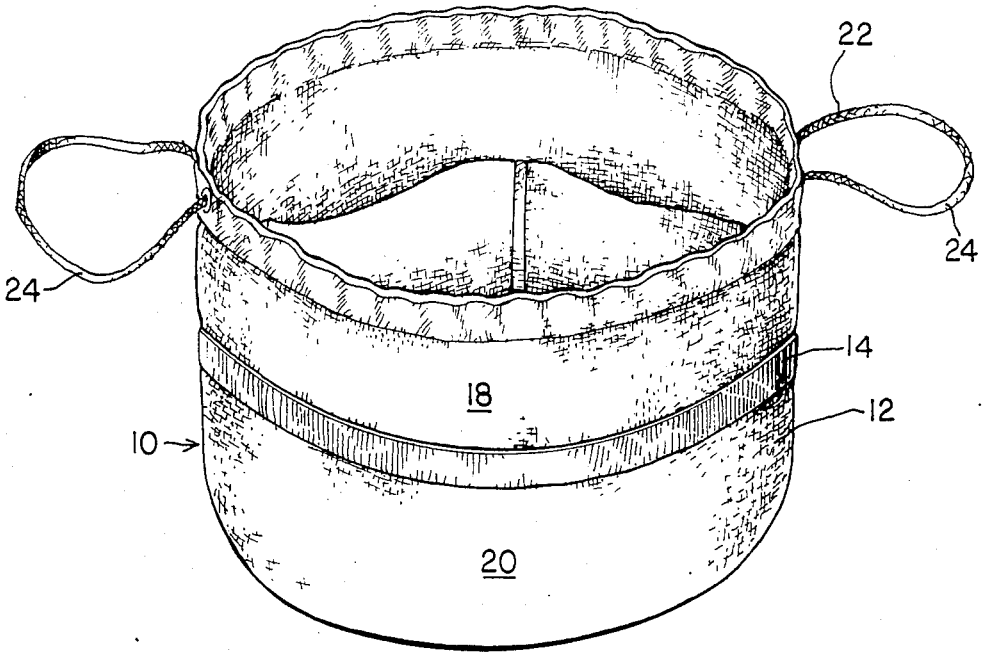
FIG. 1 is an elevational view of the invention, disclosing a portion of the invention's interior.

FIG. 1 discloses the drawstring handbag generally designated as 10. The side walls 12 may be formed of any desired fabric as long as the material is flexible. When manufacturing, the side walls are secured together so as to form a tube having top and bottom openings.

In my preferred embodiment, a strip 14 is placed around the bag for purposes to be discussed hereinafter. The strip is preferably less flexible than the side walls and may be made of a material such as leather or the like. Although the strip may be more conveniently placed about the exterior of the bag, it would also be possible to secure the strip in the interior of the bag. The top of the strip 14 is at substantially the same height as the top of pocket 16 in the interior of the bag, as shown in FIG. 1.

The strip 14 divides the side walls into a top portion 18 and bottom portion 20. In my preferred embodiment, the top of the strip 14 is one half the distance from the bottom of the bag to the top of the bag which height is the same as the top of the pocket 16.

A drawstring 22 travels about the top circumference of the bag and has two exterior loops 24 on opposite sides of the bag which when drawn will cause the top of the bag to be gathered, thereby closing the opening.

Figure 2:
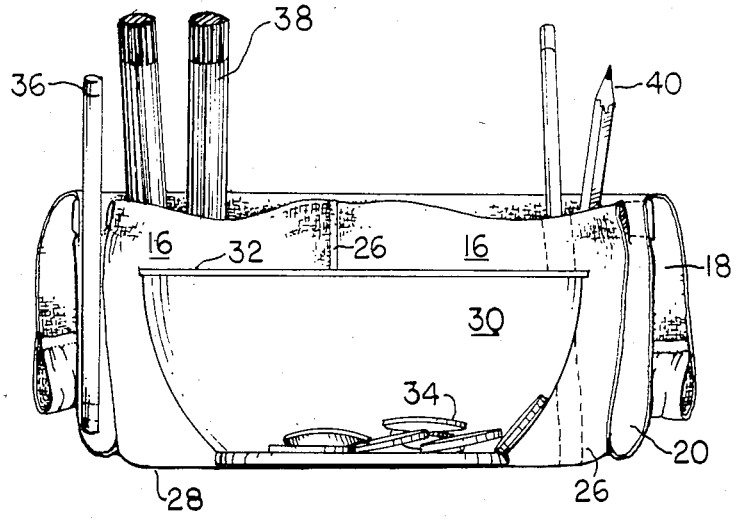
FIG. 2 is a cross-sectional view taken through the center of the handbag.

FIG. 2 is a cross-section taken vertically through the center of the bag and showing the internal contents. As shown in FIG. 2, the top portion 18 is folded downwardly about the exterior of the bottom portion 20. In use, the downward motion of the top portion quickly and easily stops at the strip 14. As seen in FIG. 2, this arrangement places the top of the pocket 16 at the new top surface of the handbag. In order to accomplish this arrange-ment, the top of the pocket 16 can extend no more than 3/5 of the distance from the bottom to the top of the bag. In my preferred embodiment, the top of the pockets are substantially ½ the distance from the top to the bottom of the bag.

When manufacturing the bag, the bottom of the material tube which is initially formed is drawn up into the interior of the tube and sewn as at points 26 so as to form pockets 16. A base 28 which may be made of any suitable material such as fabric or even a fabric and vinyl combination is then sewn, or otherwise secured, to the bottom of the side walls 12. In one of my alternate embodiments, a cup 30 is secured to the base 28 by means of an adhesive or other fastener. This cup may be utilized with a cover 32 for securely holding Bingo chips 34. Of course, it is also possible to manufacture the bag without the cup 30 and simply use the bottom portion of the bag as the holder for the Bingo chips if such an arrangement is desired.

As also shown in FIG. 2, some of the pockets 16 may be narrow, less than one inch in width, so as to be suitable for pens and pencils and the like. Thus, these various size pockets may be arranged to hold magnetic wands 36, ink markers 38, or as previously mentioned pencils 40. In addition, some of the pockets are larger in order to hold scotch tape and other items commonly used by players.

In operation, the user simply pulls the top portion of the bag open and folds the top portion down over the exterior of the bottom portion 20. A strip 14 placed around the bag serves as a stop for the easy downward folding of the top portion. The top of the pocket 16 which are in the interior of the bag are no more than 3/5 the distance from the bottom to the top of the bag and in my preferred embodiment, are half way between the top and bottom of the bag. Thus, after the top portion is folded down, the top of the pockets are extremely close to the new top surface of the bag. When strip 14 is not used, it is preferable to have the top of the pockets halfway between the bottom and top of the bag so that one may simply fold the top portion down until it contacts the surface upon which the bag is resting, thus properly exposing the pockets and their contents. The player then proceeds to make use of the various paraphenalia in the pockets as well as chips that are either placed freely within the interior of the bag or else within a cup 30 which is secured to the base of the bag. When play is completed, the top portion is simply raised back up and the drawstrings 22 are pulled so as to close the top of the bag.

The invention in its broader aspects is not limited to the specific embodiments herein shown and described but instead departures may be made therefrom which are still within the scope of the accompanying claims and do not depart from the principles of the invention nor sacrifice the chief advantages.

What is claimed is:

1. A drawstring handbag comprising:

flexible sidewalls secured together so as to form a tube, said sidewalls being sufficiently flexible so as to allow the top portion of the tube to be folded downwardly over the exterior of the bottom portion of the tube;

a base member secured to the bottom of the sidewalls thereby forming a container;

a series of pockets disposed within the interior surface of the bag, said pockets having top openings no more than 3/5 of the distance from the bottom to the top of the bag;

a strip less flexible than the sidewalls, said strip being secured about the bag such that the top of the strip is at substantially the same height as the top of the pocket openings so as to facilitate the folding of the upper portion of the bag to a point wherein the pocket openings are near the newly formed top of the bag.

2. The invention of claim 1 further comprising a cup secured within the bag to the base member.

3. The invention of claim 1 wherein the pocket openings are ½ of the distance from the bottom to the top of the bag.

* * * * *